US009799258B2

(12) United States Patent
Zou et al.

(10) Patent No.: US 9,799,258 B2
(45) Date of Patent: Oct. 24, 2017

(54) DRIVING CIRCUIT ACCORDING TO RGBW AND FLAT PANEL DISPLAY

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Gonghua Zou, Guangdong (CN); Chang Cao, Guangdong (CN); Chunpeng Guo, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 123 days.

(21) Appl. No.: 14/905,789

(22) PCT Filed: Sep. 9, 2015

(86) PCT No.: PCT/CN2015/089273

§ 371 (c)(1),
(2) Date: Jan. 16, 2016

(87) PCT Pub. No.: WO2017/035855

PCT Pub. Date: Mar. 9, 2017

(65) Prior Publication Data

US 2017/0236465 A1 Aug. 17, 2017

(30) Foreign Application Priority Data

Aug. 28, 2015 (CN) ..... 2015 1 0541008

(51) Int. Cl.
*G09G 3/20* (2006.01)

(52) U.S. Cl.
CPC ..... *G09G 3/2074* (2013.01); *G09G 3/2003* (2013.01); *G09G 3/2092* (2013.01); *G09G 2300/0452* (2013.01)

(58) Field of Classification Search
CPC .. G09G 3/2003; G09G 3/2074; G09G 3/2092; G09G 2300/0452
See application file for complete search history.

(56) References Cited

U.S. PATENT DOCUMENTS 6,583,577 B1 6/2003 Choi et al.
6,771,028 B1 * 8/2004 Winters ..... G09G 3/3233 315/169.1

(Continued)

FOREIGN PATENT DOCUMENTS

CN 1702724 A 11/2005
CN 1801298 A 7/2006

(Continued)

OTHER PUBLICATIONS

International Search Report of PCTCN2015089273.

*Primary Examiner* — Ryan A Lubit
(74) *Attorney, Agent, or Firm* — Andrew C. Cheng

(57) ABSTRACT

The present invention discloses a driving circuit according to RGBW and a flat panel display. In the driving circuit: control terminals of a first and second voltage-level switches and a first non-voltage-level switch are connected to a first driving line, input terminals are connected to a driving signal source, output terminals are respectively connected to input terminals of a third non-voltage-level switch, a third and fourth voltage-level switches, control terminals of the third non-voltage-level switch and the third and fourth voltage-level switches are connected to a second driving line, output terminals of the third non-voltage-level switch and the third and fourth voltage-level switches are connected to a first to third sub-pixels. The circuit can implement that a size (Continued)

occupied by the driving lines is decreased and the aperture ratio of the display is increased.

10 Claims, 3 Drawing Sheets

(56) References Cited

U.S. PATENT DOCUMENTS

| | | | | |
|---|---|---|---|---|
| 2007/0013613 | A1* | 1/2007 | Umezaki | G09G 3/20 345/55 |
| 2008/0068307 | A1 | 3/2008 | Kawabe | |
| 2012/0256202 | A1 | 10/2012 | Lee | |
| 2014/0054624 | A1* | 2/2014 | Chen | G09G 3/32 257/89 |
| 2014/0354520 | A1 | 12/2014 | Sato et al. | |
| 2016/0035288 | A1* | 2/2016 | Chu Ke | G09G 3/207 345/690 |
| 2016/0314736 | A1* | 10/2016 | Sang | G09G 3/3607 |
| 2017/0039928 | A1* | 2/2017 | Zhang | G02F 1/133 |
| 2017/0124948 | A1* | 5/2017 | Minami | G09G 3/3233 |

FOREIGN PATENT DOCUMENTS

| | | | |
|---|---|---|---|
| CN | 1897090 | A | 1/2007 |
| CN | 101156245 | A | 4/2008 |
| CN | 101183512 | A | 5/2008 |
| CN | 101266744 | A | 9/2008 |
| CN | 101412300 | A | 4/2009 |
| CN | 102593148 | A | 7/2012 |
| CN | 103150965 | A | 6/2013 |
| CN | 103811668 | A | 5/2014 |
| CN | 104091559 | A | 10/2014 |
| CN | 104538425 | A | 4/2015 |
| CN | 104751791 | A | 7/2015 |
| CN | 105206763 | A | 12/2015 |
| CN | 105552246 | A | 5/2016 |
| JP | 2007010811 | A | 1/2007 |
| WO | 2015037327 | A1 | 3/2015 |

* cited by examiner

DRIVING CIRCUIT ACCORDING TO RGBW AND FLAT PANEL DISPLAY

CROSS-REFERENCE TO RELATED APPLICATIONS

This application claims the priority of Chinese Patent Application No. 201510541008.3, entitled "driving circuit according to RGBW and flat panel display", filed on Aug. 28, 2015, the disclosure of which is incorporated herein by reference in its entirety.

FIELD OF THE INVENTION

The present invention relates to a liquid crystal display field, and more particularly to a driving circuit according to RGBW and flat panel display.

BACKGROUND OF THE INVENTION

As shown in FIG. 1, a pixel point of a conventional flat panel display includes three sub-pixels including red, green and blue (RGB). Each sub-pixel has a total of 256 gray levels from 0 to 255. Different colors are formed by combining different gray levels of the red, green and blue sub-pixels. With the development of a flat panel display, people demand more and more high definition of the flat panel display and more and more high resolution. This results in less and less aperture ratio of the flat panel display with the same size and less and less transmittance of a backlight thereof. Therefore, a present RGB model cannot satisfy the requirements of developing the flat panel display. An RGBW model is innovated from a basis of the conventional three basic colors RGB and adds a white sub-pixel. A transmittance of the white sub-pixel is three times of that of any one of the red, green and blue sub-pixels. Accordingly, a transmittance of an entire flat panel display can be efficiently increased.

As shown in FIG. 2, the pixel point including the red, green, blue and white sub-pixels requires a driving circuit to drive. The driving circuit according to RGBW comprises: a first driving lines 201, a second driving lines 202, a third driving lines 203, a fourth driving lines 204, a first switch K1, a second switch K2, a third switch K3 and a fourth switch K4, a control terminal of the first switch K1 connected to the first driving line 201, an input terminal of the first switch K1 connected to a driving signal source 205, another input terminal of the first switch K1 connected to the red sub-pixel, a control terminal of the second switch K2 connected to the second driving line 202, an input terminal of the second switch K2 connected to the driving signal source 205, another input terminal of the second switch K2 connected to the green sub-pixel, a control terminal of the third switch K3 connected to the third driving line 203, an input terminal of the third switch K3 connected to the driving signal source 205, another input terminal of the third switch K3 connected to the blue sub-pixel, a control terminal of the fourth switch K4 connected to the fourth driving line 204, an input terminal of the fourth switch K4 connected to a driving signal source 205 and another input terminal of the fourth switch K4 connected to the white sub-pixel.

When the first driving line 201 outputs a high voltage level, the second driving line 202 outputs a low voltage level, the third driving line 203 outputs a low voltage level and the fourth driving line 204 outputs a low voltage level, the first switch K1 is turned on, the second switch K2 is turned off, the third switch K3 is turned off and the fourth switch K4 is turned off. A driving signal from the driving signal source 205 is outputted to the red sub-pixel through the first switch K1 so the red sub-pixel generates a red light through a light generated by the backlight lamp.

When the first driving line 201 outputs a low voltage level, the second driving line 202 outputs a high voltage level, the third driving line 203 outputs the low voltage level and the fourth driving line 204 outputs the low voltage level, the first switch K1 is turned off, the second switch K2 is turned on, the third switch K3 is turned off and the fourth switch K4 is turned off. The driving signal from the driving signal source 205 is outputted to the green sub-pixel through the second switch K2 so the green sub-pixel generates a green light through the light generated by the backlight lamp.

When the first driving line 201 outputs the low voltage level, the second driving line 202 outputs the low voltage level, the third driving line 203 outputs a high voltage level and the fourth driving line 204 outputs the low voltage level, the first switch K1 is turned off, the second switch K2 is turned off, the third switch K3 is turned on and the fourth switch K4 is turned off. The driving signal from the driving signal source 205 is outputted to the blue sub-pixel through the third switch K3 so the blue sub-pixel generates a blue light through the light generated by the backlight lamp.

When the first driving line 201 outputs the low voltage level, the second driving line 202 outputs the low voltage level, the third driving line 203 outputs the low voltage level and the fourth driving line 204 outputs a high voltage level, the first switch K1 is turned off, the second switch K2 is turned off, the third switch K3 is turned off and the fourth switch K4 is turned on. The driving signal from the driving signal source 205 is outputted to the white sub-pixel through the fourth switch K4 so the white sub-pixel generates a white light through the light generated by the backlight lamp.

Therefore, driving the four sub-pixels including red, green, blue and white requires four driving lines, but a large area is occupied by the driving lines to decrease the aperture ratio of the flat panel display.

SUMMARY OF THE INVENTION

The technical issue that the embodiment of the present invention solves is to provide a driving circuit according to RGBW and a flat panel display to decrease the area occupied by the driving lies and to increase the aperture ratio of the flat panel display.

The present provides the driving circuit according to RGBW comprising: a first driving line, a second driving line, a first voltage-level switch, a second voltage-level switch, a third voltage-level switch, a fourth voltage-level switch, a first non-voltage-level switch, a second non-voltage-level switch, a third non-voltage-level switch and a fourth non-voltage-level switch, wherein a voltage-level switch is a switch, which is turned on when a first voltage level is inputted to a control terminal thereof, and a non-voltage-level switch is a switch, which is turned on when a second voltage level is inputted to a control terminal thereof; a control terminal of the first voltage-level switch connected to the first driving line, an input terminal of the first voltage-level switch connected to the driving signal source, an output terminal of the first voltage-level switch connected to an input terminal of the third non-voltage level, a control terminal of the third non-voltage-level switch connected to the second driving line and an input terminal of the third non-voltage-level switch used to connect to a first sub-pixel; a control terminal of the second voltage-level switch connected to the first driving line, an input terminal of the second voltage-level switch connected to the driving signal source, an output terminal of the second voltage-level switch connected to an input terminal of the third voltage-level switch, a control terminal of the third voltage-level connected to the second driving line, an output terminal of the third voltage-level switch used to connect to a second sub-pixel; a control terminal of the first non-voltage-level switch connected to the first driving line, an input terminal of the first non-voltage-level connected to the driving signal source, an output terminal of the first non-voltage-level connected to an input terminal of the fourth voltage-level switch, a control terminal of the fourth voltage-level switch connected to the second driving line, an output terminal of the fourth voltage-level switch used to connect to a third sub-pixel; a control terminal of the second non-voltage-level switch connected to the first driving line, an input terminal of the second non-voltage-level connected to the driving signal source, an output terminal of the second non-voltage-level connected to an input terminal of the fourth non-voltage-level switch, a control terminal of the fourth non-voltage-level switch connected to the second driving line, an output terminal of the fourth non-voltage-level switch used to connect to a fourth sub-pixel;

when the first driving line outputs a first voltage level, the second driving line outputs the second voltage level, the first voltage-level switch and the third non-voltage-level switch are turned on, a driving signal outputted from the driving signal source outputted to the first sub-pixel through the first voltage-level switch and the third non-voltage-level switch; when the first driving line outputs the first voltage level, the second driving line outputs the first voltage level, the second voltage-level switch and the third voltage-level switch are turned on, the driving signal outputted from the driving signal source outputted to the second sub-pixel through the second voltage-level switch and the third voltage-level switch; when the first driving line outputs the second voltage level, the second driving line outputs the first voltage level, the first non-voltage-level switch and the fourth voltage-level switch are turned on, the driving signal outputted from the driving signal source outputted to the third sub-pixel through the first non-voltage-level switch and the fourth voltage-level switch; when the first driving line outputs the second voltage level, the second driving line outputs the second voltage level, the second non-voltage-level switch and the fourth non-voltage-level switch are turned on, the driving signal outputted from the driving signal source outputted to the fourth sub-pixel through the second non-voltage-level switch and the fourth non-voltage-level switch.

Selectively, the first voltage level is a high voltage level and the second voltage level is a low voltage level, the voltage-level switch is a switch, which is turned on by the high voltage level, and the non-voltage-level switch is a switch, which is turned on by the low voltage level.

Selectively, the switch, which is turned on by the high voltage level, is a N type FET or C type FET and the switch, which is turned on by the low voltage level, is a P type FET.

Selectively, the first voltage level is the low voltage level and the second voltage level is the high voltage level, the voltage-level switch is a switch, which is turned on by the low voltage level, and the non-voltage-level switch is a switch, which is turned on by the high voltage level.

Selectively, the switch, which is turned on by the high voltage level, is a N type FET or C type FET and the switch, which is turned on by the low voltage level, is a P type FET.

The present invention further provides a flat panel display, comprising a flat display panel and a bottom plate, wherein the flat display panel comprises an RGBW driving circuit and the RGBW driving circuit comprises: a first driving line, a second driving line, a first voltage-level switch, a second voltage-level switch, a third voltage-level switch, a fourth voltage-level switch, a first non-voltage-level switch, a second non-voltage-level switch, a third non-voltage-level switch and a fourth non-voltage-level switch, wherein a voltage-level switch is a switch, which is turned on when a first voltage level is inputted to a control terminal thereof, and a non-voltage-level switch is a switch, which is turned on when a second voltage level is inputted to a control terminal thereof; a control terminal of the first voltage-level switch connected to the first driving line, an input terminal of the first voltage-level switch connected to the driving signal source, an output terminal of the first voltage-level switch connected to an input terminal of the third non-voltage level, a control terminal of the third non-voltage-level switch connected to the second driving line and an input terminal of the third non-voltage-level switch used to connect to a first sub-pixel; a control terminal of the second voltage-level switch connected to the first driving line, an input terminal of the second voltage-level switch connected to the driving signal source, an output terminal of the second voltage-level switch connected to an input terminal of the third voltage-level switch, a control terminal of the third voltage-level connected to the second driving line, an output terminal of the third voltage-level switch used to connect to a second sub-pixel; a control terminal of the first non-voltage-level switch connected to the first driving line, an input terminal of the first non-voltage-level connected to the driving signal source, an output terminal of the first non-voltage-level connected to an input terminal of the fourth voltage-level switch, a control terminal of the fourth voltage-level switch connected to the second driving line, an output terminal of the fourth voltage-level switch used to connect to a third sub-pixel; a control terminal of the second non-voltage-level switch connected to the first driving line, an input terminal of the second non-voltage-level connected to the driving signal source, an output terminal of the second non-voltage-level connected to an input terminal of the fourth non-voltage-level switch, a control terminal of the fourth non-voltage-level switch connected to the second driving line, an output terminal of the fourth non-voltage-level switch used to connect to a fourth sub-pixel;

when the first driving line outputs a first voltage level, the second driving line outputs the second voltage level, the first voltage-level switch and the third non-voltage-level switch are turned on, a driving signal outputted from the driving signal source outputted to the first sub-pixel through the first voltage-level switch and the third non-voltage-level switch; when the first driving line outputs the first voltage level, the second driving line outputs the first voltage level, the second voltage-level switch and the third voltage-level switch are turned on, the driving signal outputted from the driving signal source outputted to the second sub-pixel through the second voltage-level switch and the third voltage-level switch; when the first driving line outputs the second voltage level, the second driving line outputs the first voltage level, the first non-voltage-level switch and the fourth voltage-level switch are turned on, the driving signal outputted from the driving signal source outputted to the third sub-pixel through the first non-voltage-level switch and the fourth voltage-level switch; when the first driving line outputs the second voltage level, the second driving line outputs the second voltage level, the second non-voltage-level switch and the fourth non-voltage-level switch are turned on, the driving signal outputted from the driving signal source outputted to the fourth sub-pixel through the second non-voltage-level switch and the fourth non-voltage-level switch.

Selectively, the first voltage level is a high voltage level and the second voltage level is a low voltage level, the voltage-level switch is a switch, which is turned on by the high voltage level, and the non-voltage-level switch is a switch, which is turned on by the low voltage level.

Selectively, the switch, which is turned on by the high voltage level, is a N type FET or C type FET and the switch, which is turned on by the low voltage level, is a P type FET.

Selectively, the first voltage level is the low voltage level and the second voltage level is the high voltage level, the voltage-level switch is a switch, which is turned on by the low voltage level, and the non-voltage-level switch is a switch, which is turned on by the high voltage level.

Selectively, the switch, which is turned on by the high voltage level, is a N type FET or C type FET and the switch, which is turned on by the low voltage level, is a P type FET.

With implementing the embodiment of the present invention to drive the four sub-pixels of the RGBW model by a time sequence cooperation of the two driving lines the eight switches. Compared with the original way of using the four driving lines to drive the four sub-pixels, the numbers of the driving lines are decreased and the area occupied by the driving lines is decreased to increase the aperture ratio of the flat panel display.

BRIEF DESCRIPTION OF THE DRAWINGS

In order to more clearly illustrate the embodiments of the present invention or prior art, the following figures will be described in the embodiments are briefly introduced. It is obvious that the drawings are merely some embodiments of the present invention, those of ordinary skill in this field can obtain other figures according to these figures without paying the premise.

DETAILED DESCRIPTION OF THE PREFERRED EMBODIMENTS

Embodiments of the present invention are described in detail with the technical matters, structural features, achieved objects, and effects with reference to the accompanying drawings as follows. It is clear that the described embodiments are part of embodiments of the present invention, but not all embodiments. Based on the embodiments of the present invention, all other embodiments to those of ordinary skill in the premise of no creative efforts obtained, should be considered within the scope of protection of the present invention.

Specifically, the terminologies in the embodiments of the present invention are merely for describing the purpose of the certain embodiment, but not to limit the invention. Examples and the appended claims be implemented in the present invention requires the use of the singular form of the book "an", "the" and "the" are intended to include most forms unless the context clearly dictates otherwise. It should also be understood that the terminology used herein that "and/or" means and includes any or all possible combinations of one or more of the associated listed items.

Figure 1:
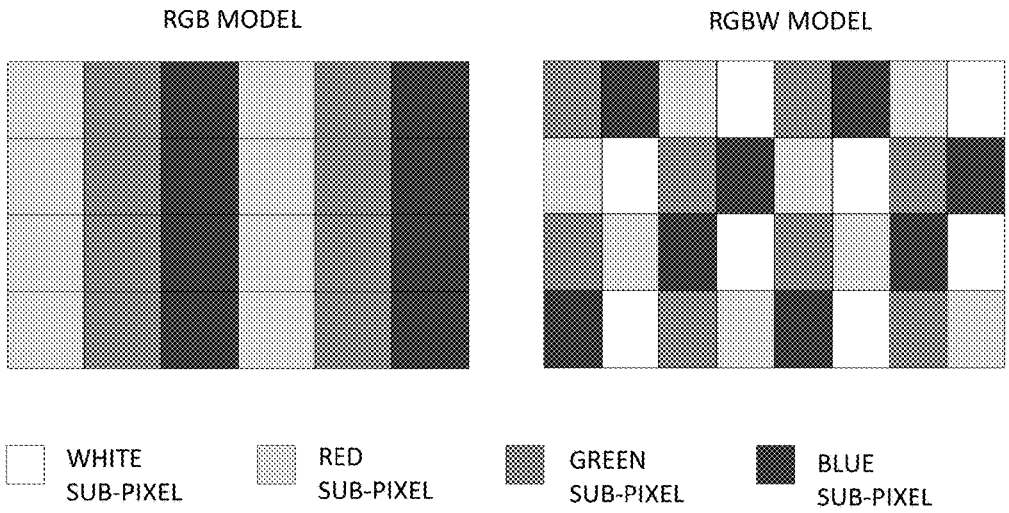
FIG. 1 (PRIOR ART)
FIG. 1 is a comparison diagram of a flat panel display according to an RGB model and a flat panel display according to an RGBW model.
Figure 2:
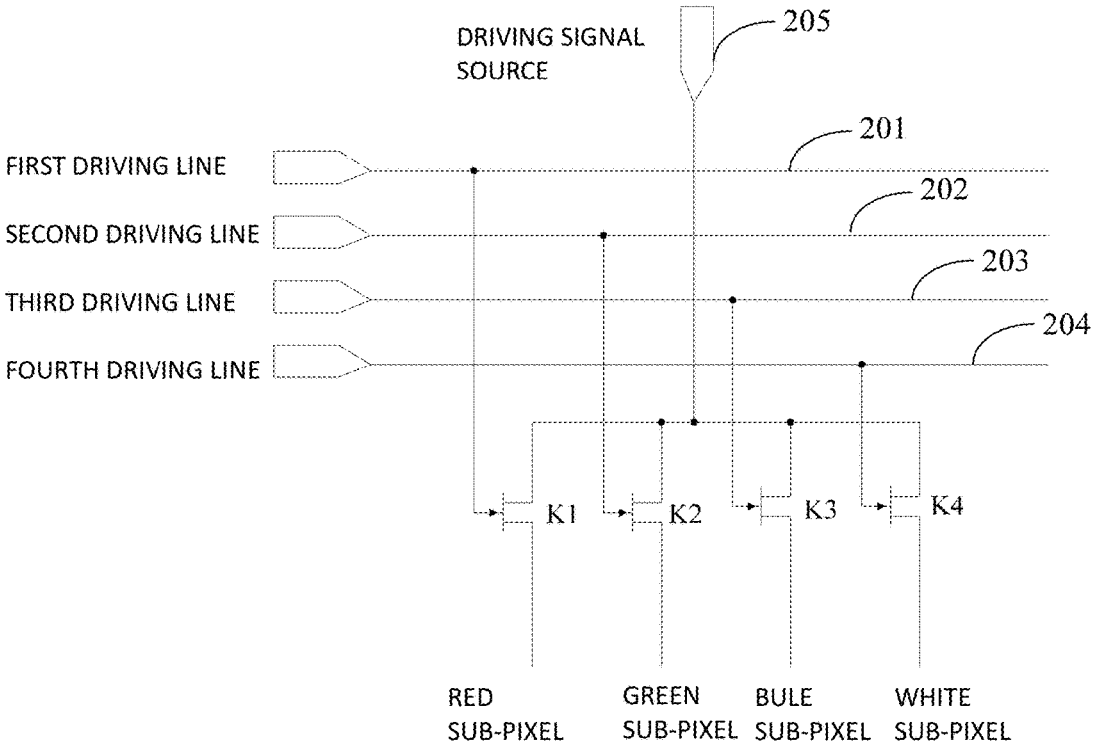
FIG. 2 (PRIOR ART)
FIG. 2 is a circuit diagram of a conventional driving circuit of the prior art.
Figure 3:
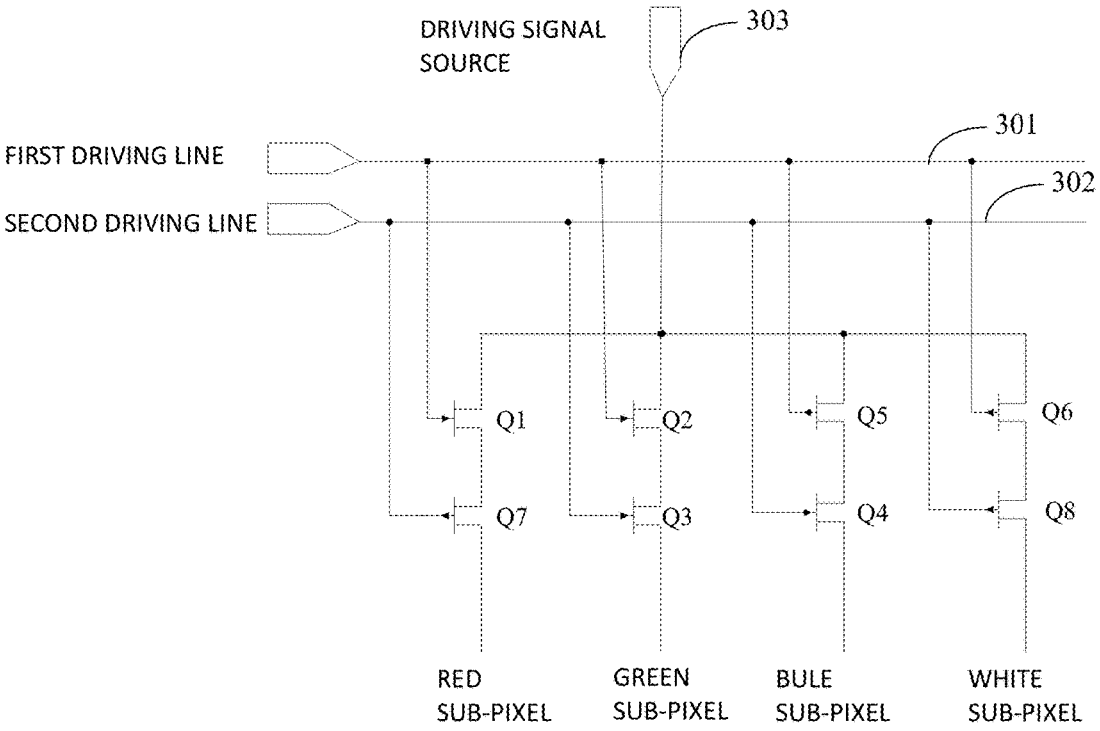
FIG. 3 is a circuit diagram of a driving circuit according to the RGBW of an embodiment of the present invention.

Please refer to FIG. 3. FIG. 3 is a circuit diagram of a driving circuit according to the RGBW of an embodiment of the present invention. The driving circuit according to the RGBW of the present embodiment comprises: a first driving line 301, a second driving line 302, a first voltage-level switch Q1, a second voltage-level switch Q2, a third voltage-level switch Q3, a fourth voltage-level switch Q4, a first non-voltage-level switch Q5, a second non-voltage-level switch Q6, a third non-voltage-level switch Q7 and a fourth non-voltage-level switch Q8, wherein the voltage-level switch is a switch, which is turned on when a first voltage level is output to a control terminal thereof, and the non-voltage-level switch is a switch, which is turned on when a second voltage level is output to a control terminal thereof.

A control terminal of the first voltage-level switch Q1 is connected to the first driving line 301, an input terminal of the first voltage-level switch Q1 is connected to a driving signal source 303, an output terminal of the first voltage-level switch Q1 is connected to an input terminal of the third non-voltage-level switch Q7, a control terminal of the third non-voltage-level switch Q7 is connected to the second driving line 302 and an output terminal of the third non-voltage-level switch Q7 is connected to the red sub-pixel.

A control terminal of the second voltage-level switch Q2 is connected to the first driving line 301, an input terminal of the second voltage-level switch Q2 is connected to the driving signal source 303, an output terminal of the second voltage-level switch Q2 is connected to an input terminal of the third voltage-level switch Q3, a control terminal of the third voltage-level switch Q3 is connected to the second driving line 302 and an output terminal of the third voltage-level switch Q3 is connected to the green sub-pixel.

A control terminal of the first non-voltage-level switch Q5 is connected to the first driving line 301, an input terminal of the first non-voltage-level switch Q5 is connected to the driving signal source 303, an output terminal of the first non-voltage-level switch Q5 is connected to an input terminal of the fourth voltage-level switch Q4, a control terminal of the fourth voltage-level switch Q4 is connected to the second driving line 302 and an output terminal of the fourth voltage-level switch Q4 is connected to the blue sub-pixel.

A control terminal of the second non-voltage-level switch Q6 is connected to the first driving line 301, an input terminal of the second non-voltage-level switch Q6 is connected to the driving signal source 303, an output terminal of the second non-voltage-level switch Q6 is connected to an input terminal of the fourth non-voltage-level switch Q8, a control terminal of the fourth non-voltage-level switch Q8 is connected to the second driving line 302 and an output terminal of the fourth non-voltage-level switch Q8 is connected to the white sub-pixel.

When the first driving line 301 outputs a high voltage level, the second driving line outputs a low voltage level, the first voltage-level switch Q1 and the third non-voltage-level switch Q7 are turned on, the driving signal outputted from the driving signal source 303 is outputted to the red sub-pixel through the first voltage-level switch Q1 and the third non-voltage-level switch Q7. At the time, in an operation of the first driving line 301 and the second driving line 302, the second voltage-level switch Q2 is turned on and the third voltage-level switch Q3 is turned off, so the driving signal outputted from the driving signal source 303 is not outputted to the green sub-pixel through the second voltage-level switch Q2 and the third voltage-level switch Q3. The first non-voltage-level switch Q5 is turned off and the fourth voltage-level switch Q4 is turned off, so the driving signal outputted from the driving signal source 303 is not outputted to the blue sub-pixel through the first non-voltage-level switch Q5 and the fourth voltage-level switch Q4. The second non-voltage-level switch Q6 is turned off and the fourth non-voltage-level switch Q8 is turned on, so the driving signal outputted from the driving signal source 303 is not outputted to the white sub-pixel through the second non-voltage-level switch Q6 and the fourth non-voltage-level switch Q8.

When the first driving line 301 outputs the high voltage level, the second driving line outputs a high voltage level, the second voltage-level switch Q2 and the third voltage-level switch Q3 are turned on, the driving signal outputted from the driving signal source 303 is outputted to the green sub-pixel through the second voltage-level switch Q2 and the third voltage-level switch Q3. At the time, in the operation of the first driving line 301 and the second driving line 302, the first voltage-level switch Q1 is turned on and the seventh non-voltage-level switch Q7 is turned off, so the driving signal outputted from the driving signal source 303 is not outputted to the red sub-pixel through the first voltage-level switch Q1 and the seventh non-voltage-level switch Q7. The first non-voltage-level switch Q5 is turned off and the fourth voltage-level switch Q4 is turned on, so the driving signal outputted from the driving signal source 303 is not outputted to the blue sub-pixel through the first non-voltage-level switch Q5 and the fourth voltage-level switch Q4. The second non-voltage-level switch Q6 is turned off and the fourth non-voltage-level switch Q8 is turned off, so the driving signal outputted from the driving signal source 303 is not outputted to the white sub-pixel through the second non-voltage-level switch Q6 and the fourth non-voltage-level switch Q8.

When the first driving line 301 outputs a low voltage level, the second driving line outputs the high voltage level, the first non-voltage-level switch Q5 and the fourth voltage-level switch Q4 are turned on, the driving signal outputted from the driving signal source 303 is outputted to the blue sub-pixel through the first non-voltage-level switch Q5 and the fourth voltage-level switch Q4. At the time, in the operation of the first driving line 301 and the second driving line 302, the first voltage-level switch Q1 is turned off and the seventh non-voltage-level switch Q7 is turned off, so the driving signal outputted from the driving signal source 303 is not outputted to the red sub-pixel through the first voltage-level switch Q1 and the seventh non-voltage-level switch Q7. The second voltage-level switch Q2 is turned off and the third voltage-level switch Q3 is turned on, so the driving signal outputted from the driving signal source 303 is not outputted to the green sub-pixel through the second voltage-level switch Q2 and the third voltage-level switch Q3. The second non-voltage-level switch Q6 is turned on and the fourth non-voltage-level switch Q8 is turned off, so the driving signal outputted from the driving signal source 303 is not outputted to the white sub-pixel through the second non-voltage-level switch Q6 and the fourth non-voltage-level switch Q8.

When the first driving line 301 outputs the low voltage level, the second driving line outputs the low voltage level, the non-voltage-level switch Q6 and the fourth non-voltage-level switch Q8 are turned on, the driving signal outputted from the driving signal source 303 is outputted to the white sub-pixel through the non-voltage-level switch Q6 and the fourth non-voltage-level switch Q8. At the time, in the operation of the first driving line 301 and the second driving line 302, the first voltage-level switch Q1 is turned off and the seventh non-voltage-level switch Q7 is turned on, so the driving signal outputted from the driving signal source 303 is not outputted to the red sub-pixel through the first voltage-level switch Q1 and the seventh non-voltage-level switch Q7. The second voltage-level switch Q2 is turned off and the third voltage-level switch Q3 is turned off, so the driving signal outputted from the driving signal source 303 is not outputted to the green sub-pixel through the second voltage-level switch Q2 and the third voltage-level switch Q3. The first non-voltage-level switch Q5 is turned on and the fourth voltage-level switch Q4 is turned off, so the driving signal outputted from the driving signal source 303 is not outputted to the blue sub-pixel through the first non-voltage-level switch Q5 and the fourth voltage-level switch Q4.

According to the foregoing logic, a control logic truth table 1 as shown in Table 1 is obtained.

TABLE 1 control logic truth table 1

| First Driving line | Second Driving line | Q1 | Q2 | Q3 | Q4 | Q5 | Q6 | Q7 | Q8 |
|---|---|---|---|---|---|---|---|---|---|
| H | L | ON | ON | OFF | OFF | OFF | OFF | ON | ON |
| H | H | ON | ON | ON | ON | OFF | OFF | OFF | OFF |
| L | H | OFF | OFF | ON | ON | ON | ON | OFF | OFF |
| L | L | OFF | OFF | OFF | OFF | ON | ON | ON | ON |

Wherein, H represents a high voltage level and L represents a low voltage level.

At the time, the voltage-level switch is a switch, which is turned on by a high voltage level. For example, N type FET or C type FET etc. The non-voltage-level switch is a switch, which is turned on by a low voltage level. For example, P type FET etc.

It can understand that positions of the red, green, blue and white sub-pixels can be exchanged and an work efficiency of the driving circuit is not affected.

With implementing the embodiment of the present invention to drive the four sub-pixels of the RGBW model by a time sequence cooperation of the two driving lines the eight switches. Compared with the original way of using the four driving lines to drive the four sub-pixels, the numbers of the driving lines are decreased and the area occupied by the driving lines is decreased to increase the aperture ratio of the flat panel display.

Figure 4:
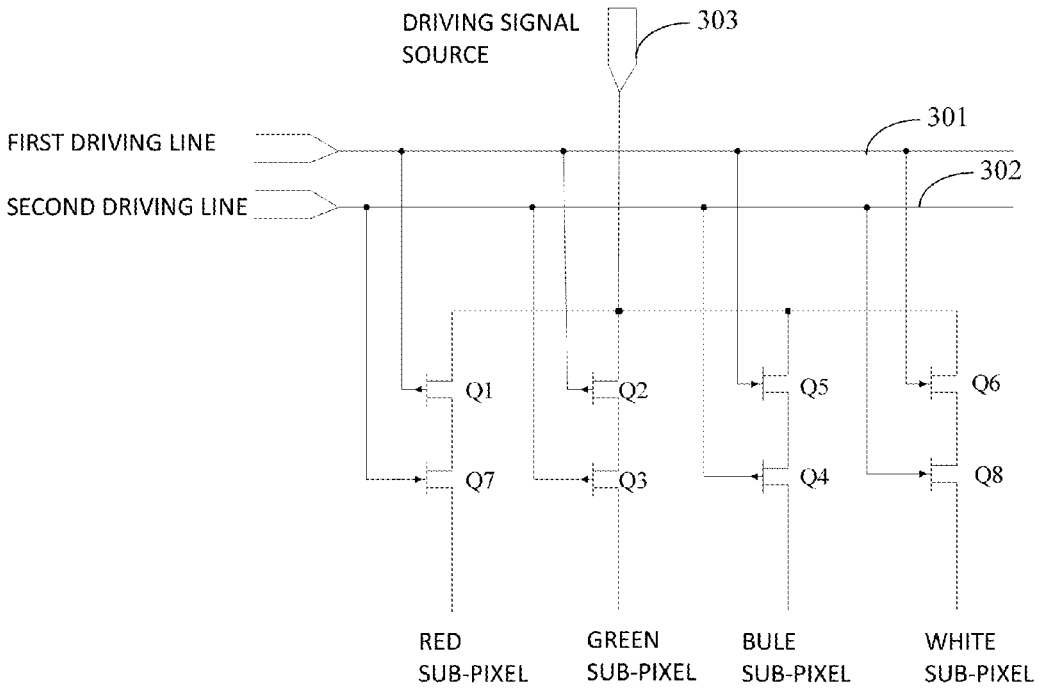
FIG. 4 is another circuit diagram of a driving circuit according to the RGBW of an embodiment of the present invention.

As shown in FIG. 4, the driving circuit may be arranged by an inversion logic. For example, the voltage-level switches of FIG. 3 are arranged to non-voltage-level switches, and the non-voltage-level switches are arranged to voltage-level switches to obtain a driving circuit as shown in FIG. 4. At the time, the voltages outputted from the first driving line 301 and the second driving line 302 are opposite to these of the previous embodiment, and driving the four sub-pixels including red, green, blue and white is implemented. According to this logic, a control logic truth table 2 as shown in Table 2 is obtained.

TABLE 2 control logic truth table 2

| First Driving line | Second Driving Line | Q1 | Q2 | Q3 | Q4 | Q5 | Q6 | Q7 | Q8 |
|---|---|---|---|---|---|---|---|---|---|
| L | H | ON | ON | OFF | OFF | OFF | OFF | ON | ON |
| L | L | ON | ON | ON | ON | OFF | OFF | OFF | OFF |
| H | L | OFF | OFF | ON | ON | ON | ON | OFF | OFF |
| H | H | OFF | OFF | OFF | OFF | ON | ON | ON | ON |

Wherein, H represents a high voltage level and L represents a low voltage level.

Please refer to FIG. 3 and related descriptions, here no longer expand description.

The present invention further provides a flat panel display comprising a flat display panel and a bottom plate. The flat display panel comprises an RGBW driving circuit. Please refer to FIG. 3 and the related descriptions, here no longer expand description.

It is understandable in practical to the person who is skilled in the art that all or portion of the processes in the method according to the aforesaid embodiment can be accomplished with the computer program to instruct the related hardwares. The program can be stored in a readable storage medium if the computer. As the program is executed, the processes of the embodiments in the aforesaid respective methods can be included. The storage medium can be a hardisk, an optical disc, a Read-Only Memory (ROM) or a Random Access Memory (RAM).

Above are embodiments of the present invention, which does not limit the scope of the present invention. Any modifications, equivalent replacements or improvements within the spirit and principles of the embodiment described above should be covered by the protected scope of the invention.

What is claimed is:

1. A driving circuit for driving a RGBW pixel of a display, the driving circuit comprising:

a first driving line, a second driving line, a first voltage-level switch, a second voltage-level switch, a third voltage-level switch, a fourth voltage-level switch, a first non-voltage-level switch, a second non-voltage-level switch, a third non-voltage-level switch and a fourth non-voltage-level switch, wherein a voltage-level switch is a switch, which is turned on when a first voltage level is inputted to a control terminal thereof, and a non-voltage-level switch is a switch, which is turned on when a second voltage level is inputted to a control terminal thereof;

a control terminal of the first voltage-level switch connected to the first driving line, an input terminal of the first voltage-level switch connected to a driving signal source, an output terminal of the first voltage-level switch connected to an input terminal of the third non-voltage level switch, a control terminal of the third non-voltage-level switch connected to the second driving line and an input terminal of the third non-voltage-level switch used to connect to a first sub-pixel;

a control terminal of the second voltage-level switch connected to the first driving line, an input terminal of the second voltage-level switch connected to the driving signal source, an output terminal of the second voltage-level switch connected to an input terminal of the third voltage-level switch, a control terminal of the third voltage-level switch connected to the second driving line, an output terminal of the third voltage-level switch used to connect to a second sub-pixel;

a control terminal of the first non-voltage-level switch connected to the first driving line, an input terminal of the first non-voltage level switch connected to the driving signal source, an output terminal of the first non-voltage level switch connected to an input terminal of the fourth voltage-level switch, a control terminal of the fourth voltage-level switch connected to the second driving line, an output terminal of the fourth voltage-level switch used to connect to a third sub-pixel;

a control terminal of the second non-voltage-level switch connected to the first driving line, an input terminal of the second non-voltage level switch connected to the driving signal source, an output terminal of the second non-voltage level switch connected to an input terminal of the fourth non-voltage-level switch, a control terminal of the fourth non-voltage-level switch connected to the second driving line, an output terminal of the fourth non-voltage-level switch used to connect to a fourth sub-pixel;

when the first driving line outputs a first voltage level, the second driving line outputs the second voltage level, the first voltage-level switch and the third non-voltage-level switch are turned on, a driving signal outputted from the driving signal source outputted to the first sub-pixel through the first voltage-level switch and the third non-voltage-level switch;

when the first driving line outputs the first voltage level, the second driving line outputs the first voltage level, the second voltage-level switch and the third voltage-level switch are turned on, the driving signal outputted from the driving signal source outputted to the second sub-pixel through the second voltage-level switch and the third voltage-level switch;

when the first driving line outputs the second voltage level, the second driving line outputs the first voltage level, the first non-voltage-level switch and the fourth voltage-level switch are turned on, the driving signal outputted from the driving signal source outputted to the third sub-pixel through the first non-voltage-level switch and the fourth voltage-level switch;

when the first driving line outputs the second voltage level, the second driving line outputs the second voltage level, the second non-voltage-level switch and the fourth non-voltage-level switch are turned on, the driving signal outputted from the driving signal source outputted to the fourth sub-pixel through the second non-voltage-level switch and the fourth non-voltage-level switch.

2. The circuit according to claim 1, characterized in that the first voltage level is a high voltage level and the second voltage level is a low voltage level, the voltage-level switch is a switch, which is turned on by the high voltage level, and the non-voltage-level switch is a switch, which is turned on by the low voltage level.

3. The circuit according to claim 2, characterized in that the switch, which is turned on by the high voltage level, is a N type FET or C type FET and the switch, which is turned on by the low voltage level, is a P type FET.

4. The circuit according to claim 1, characterized in that the first voltage level is the low voltage level and the second voltage level is the high voltage level, the voltage-level switch is a switch, which is turned on by the low voltage level, and the non-voltage-level switch is a switch, which is turned on by the high voltage level.

5. The circuit according to claim 4, characterized in that the switch, which is turned on by the high voltage level, is a N type FET or C type FET and the switch, which is turned on by the low voltage level, is a P type FET.

6. A flat panel display comprising:

a flat display panel and a bottom plate, wherein the flat display panel comprises an RGBW driving circuit and the RGBW driving circuit comprises:

a first driving line, a second driving line, a first voltage-level switch, a second voltage-level switch, a third voltage-level switch, a fourth voltage-level switch, a first non-voltage-level switch, a second non-voltage-level switch, a third non-voltage-level switch and a fourth non-voltage-level switch, wherein a voltage-level switch is a switch, which is turned on when a first voltage level is inputted to a control terminal thereof, and a non-voltage-level switch is a switch, which is turned on when a second voltage level is inputted to a control terminal thereof;

a control terminal of the first voltage-level switch connected to the first driving line, an input terminal of the first voltage-level switch connected to a driving signal source, an output terminal of the first voltage-level switch connected to an input terminal of the third non-voltage level switch, a control terminal of the third non-voltage-level switch connected to the second driving line and an input terminal of the third non-voltage-level switch used to connect to a first sub-pixel;

a control terminal of the second voltage-level switch connected to the first driving line, an input terminal of the second voltage-level switch connected to the driving signal source, an output terminal of the second voltage-level switch connected to an input terminal of the third voltage-level switch, a control terminal of the third voltage-level switch connected to the second driving line, an output terminal of the third voltage-level switch used to connect to a second sub-pixel;

a control terminal of the first non-voltage-level switch connected to the first driving line, an input terminal of the first non-voltage level switch connected to the driving signal source, an output terminal of the first non-voltage level switch connected to an input terminal of the fourth voltage-level switch, a control terminal of the fourth voltage-level switch connected to the second driving line, an output terminal of the fourth voltage-level switch used to connect to a third sub-pixel;

a control terminal of the second non-voltage-level switch connected to the first driving line, an input terminal of the second non-voltage level switch connected to the driving signal source, an output terminal of the second non-voltage level switch connected to an input terminal of the fourth non-voltage-level switch, a control terminal of the fourth non-voltage-level switch connected to the second driving line, an output terminal of the fourth non-voltage-level switch used to connect to a fourth sub-pixel;

when the first driving line outputs a first voltage level, the second driving line outputs the second voltage level, the first voltage-level switch and the third non-voltage-level switch are turned on, a driving signal outputted from the driving signal source outputted to the first sub-pixel through the first voltage-level switch and the third non-voltage-level switch;

when the first driving line outputs the first voltage level, the second driving line outputs the first voltage level, the second voltage-level switch and the third voltage-level switch are turned on, the driving signal outputted from the driving signal source outputted to the second sub-pixel through the second voltage-level switch and the third voltage-level switch;

when the first driving line outputs the second voltage level, the second driving line outputs the first voltage level, the first non-voltage-level switch and the fourth voltage-level switch are turned on, the driving signal outputted from the driving signal source outputted to the third sub-pixel through the first non-voltage-level switch and the fourth voltage-level switch;

when the first driving line outputs the second voltage level, the second driving line outputs the second voltage level, the second non-voltage-level switch and the fourth non-voltage-level switch are turned on, the driving signal outputted from the driving signal source outputted to the fourth sub-pixel through the second non-voltage-level switch and the fourth non-voltage-level switch.

7. The flat panel display according to claim 6, characterized in that the first voltage level is a high voltage level and the second voltage level is a low voltage level, the voltage-level switch is a switch, which is turned on by the high voltage level, and the non-voltage-level switch is a switch, which is turned on by the low voltage level.

8. The flat panel display according to claim 7, characterized in that the switch, which is turned on by the high voltage level, is a N type FET or C type FET and the switch, which is turned on by the low voltage level, is a P type FET.

9. The flat panel display according to claim 6, wherein when the first voltage level is a low voltage level and the second voltage level is a high voltage level, the voltage-level switch is a switch, which is turned on by the low voltage level, and the non-voltage-level switch is a switch, which is turned on by the high voltage level.

10. The flat panel display according to claim 9, wherein the switch, which is turned on by the high voltage level, is a N type FET or C type FET; and the switch, which is turned on by the low voltage level, is a P type FET.

* * * * *